United States Patent [19]

Englert et al.

[11] 4,079,562

[45] Mar. 21, 1978

[54] SIDING STARTER CLIP FOR SECURING TO THE SIDE OF A STRUCTURE AND ENGAGING A SIDING STARTER PANEL

[75] Inventors: Herbert U. Englert, Deal; Jack Demray, Middletown, both of N.J.

[73] Assignee: Englert Metals Corporation, Perth Amboy, N.J.

[21] Appl. No.: 732,398

[22] Filed: Oct. 14, 1976

Related U.S. Application Data

[63] Continuation of Ser. No. 573,584, Apr. 30, 1975, abandoned.

[51] Int. Cl.[2] ..... E04D 1/34

[52] U.S. Cl. ..... 52/545

[58] Field of Search ..... 52/520, 522, 543, 545, 52/547, 760

[56] References Cited

U.S. PATENT DOCUMENTS

| | | | |
|---|---|---|---|
| 2,358,277 | 9/1944 | Manofsky | 52/242 X |
| 2,820,535 | 1/1958 | Hutchison | 52/545 |
| 3,188,695 | 6/1965 | Spangenberg | 52/407 X |
| 3,226,901 | 1/1966 | Harter | 52/545 |
| 3,282,009 | 11/1966 | Chalmers | 52/545 X |

*Primary Examiner*—J. Karl Bell

*Attorney, Agent, or Firm*—Sommers & Sommers

[57] ABSTRACT

A siding starter clip comprised of sheet metal material, including an upper extended nailing leg portion having a plurality of apertures therein for fastening to the side of a structure by securing nails therethrough, a medial projecting leg portion which extends from the upper nailing leg portion at an obtuse included angle therewith, a lower depending leg portion which extends from the medial projecting leg portion at an acute included angle therewith for engaging a siding starter panel, and gussets extending substantially the length thereof, installable in a convenient and efficient manner to provide strengthened support for, and adjustable interlocking engagement with, a siding starter panel.

1 Claim, 3 Drawing Figures

SIDING STARTER CLIP FOR SECURING TO THE SIDE OF A STRUCTURE AND ENGAGING A SIDING STARTER PANEL

This is a continuation of application Ser. No. 573,584, filed Apr. 30, 1975 now abandoned.

BACKGROUND OF THE INVENTION

This invention relates generally to siding panel systems installable on the side walls of structures. More specifically, this invention relates to a siding starter clip for securing to the wall of a structure and engaging a siding starter panel.

A continuous strip of thin gauge metal known as a siding starter strip has been used previously for installing a siding starter panel on the side of a structure. Such strips included a nailing leg portion for securing to the side wall of the structure and an interlocking portion for engaging the siding starter panel. In installing such strips, the installer first determined the desired position of the strip, then struck a line around the structure corresponding to the height of the top edge of the strip above ground level for the desired location of the strip and panel, then positioned the strip to align the top edge thereof with the struck line, then hammered nails through the nailing leg portion thereof for securing the strip to the side of the structure, and then engaged the interlocking portion of the strip with the corresponding interlocking portion of the siding starter panel to lock the panel on the side of the structure. In installing the siding starter panel so as to cover the foundation block of a structure, the original siding had to be furred out with furring strips nailed to the wood clapboard; substantial lowering of the siding starter panel to provide the desired covering required nailing the strip near the top of the nailing leg to provide the length of strip required to cover the exposed block substantially diminishing the rigidity of the siding starter strip and of the siding starter panel engaged therewith. Such siding starter strips were susceptible to bending and crimping in manufacture, delivery and installation thereof, which severely hampered installation thereof and interfered with interlocking engagement with the siding starter panels; the siding starter panels were likewise susceptible to on-site bending and crimping which severely hampered installation and interfered with interlocking engagement with the siding starter strip. Variations in the contours of the side walls of the structure, such as concave or convex portions, which variations were followed by the siding starter strip when secured to the side wall, further interfered with interlocking engagement of the siding starter panel and the strip. The longer the side wall of the structure, the longer the strip secured thereto and the greater the chances for variations therein and bending and crimping thereof, making it more difficult to interlockingly engage the strip and panel.

SUMMARY OF THE INVENTION

In view of the above, it is among the objects of this invention to provide a siding starter clip for securing to the side of a structure, which is adjustably engageable with a siding starter panel to compensate for variations in the side wall of the structure, in the clip, and in the panel engageable therewith, which is conveniently installable at the job site so as to substantially reduce the difficulty and cost thereof and the time required therefor, which provides substantially strengthened support for the siding starter panel, and which enables installation on longer side walls of structures using longer siding starter panels.

The above objects and others are achieved in this invention by means of a siding starter clip comprised of sheet metal material, including an upper extended nailing leg portion having a plurality of apertures therein for fastening to the side of a structure by securing nails therethrough, a medial projecting leg portion which extends from the upper nailing leg portion at an obtuse included angle therewith a lower depending leg portion which extends from the medial projecting leg portion at an acute included angle therewith, for engaging a siding starter panel, and gussets extending substantially the length thereof, installable in a convenient and efficient manner to provide strengthened support for, and adjustable interlocking engagement with, a siding starter panel.

DESCRIPTION OF THE DRAWINGS

This invention is illustrated, by way of example, in the accompanying drawings, in which.

DESCRIPTION OF THE PREFERRED EMBODIMENT

Figure 1:
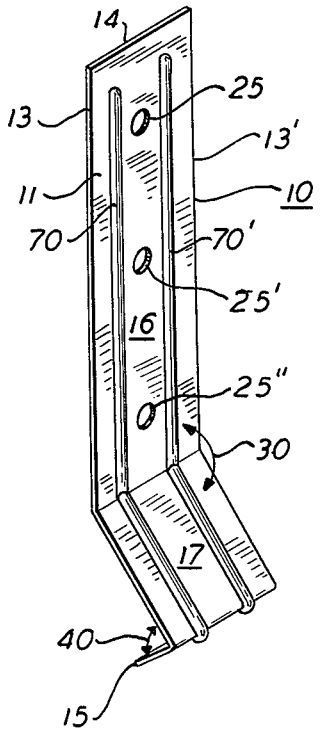
FIG. 1 is a perspective view of the siding starter clip of the invention.
Figure 3:
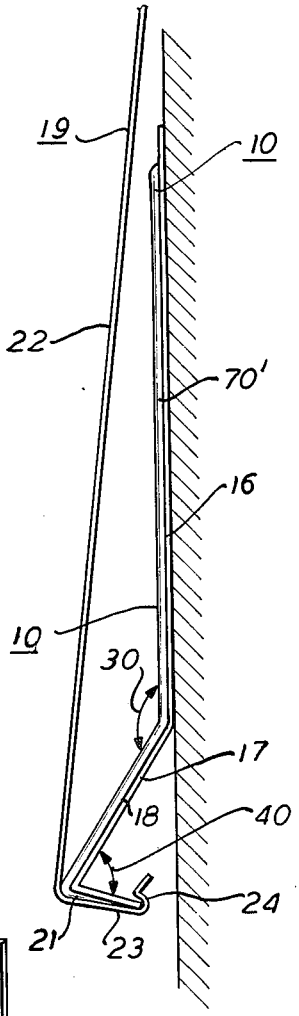
FIG. 3 is a perspective partly-sectional view of the siding starter clip engaged with the siding starter panel pursuant to the invention.
Figure 2:
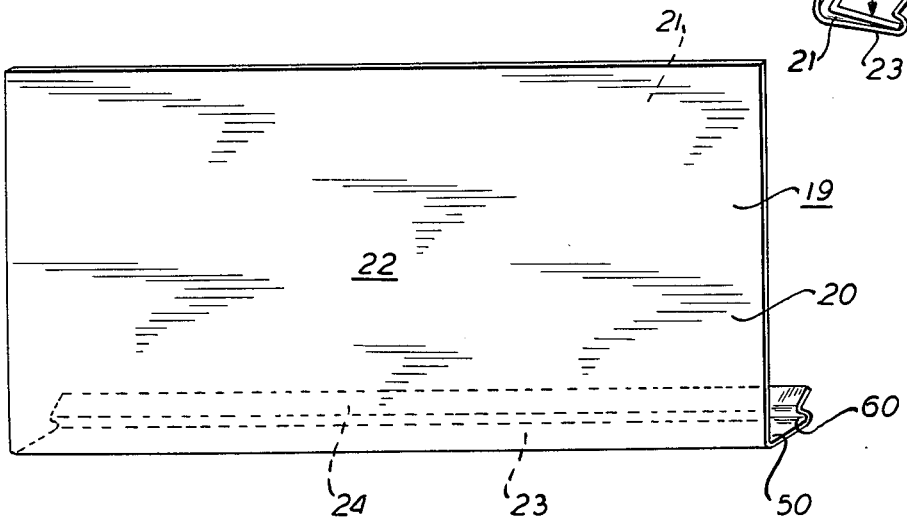
FIG. 2 is a front perspective view of a siding starter panel engageable with the siding starter clip of the invention.

In the preferred embodiment of the invention as illustrated in FIG. 1–3, the siding starter clip 10, comprised of sheet metal material of substantial thickness on the order of 0.32″ gauge, includes, for example, a front surface 11, a back surface 12, side edges 13, 13′, a top edge 14, a bottom edge 15, an upper extended nailing leg portion 16 for securing the siding starter clip 10 to the side wall of the structure on which the siding panel system is to be installed, a medial projecting leg portion 17 which extends from the upper nailing leg portion 16, and a lower depending lep portion 18 which extends from the medial projecting leg portion 17 for engaging a siding starter panel 19 which includes a front surface 20, a back surface 21, a siding portion 22, a depending portion 23 which extends rearwardly from the bottom edge of the siding portion 22, and a rear upstanding portion 24 which extends upwardly from the rear edge of the depending portion 23, and with which the clip lower depending leg portion 18 is interlockingly engageable. The clip upper nailing leg portion 11 is substantially lengthened and extended, and includes a plurality of apertures 25, 25′, 25″ therein through which nails may be fastened into the side of the structure for securing the siding starter clip 10 thereto. The included angle 30 between the front surface 11 of the upper nailing leg portion 16 and the front surface 11 of the medial projecting leg portion 17 of the siding starter clip 10 comprises an obtuse angle, and the included angle 40 between the back surface 12 of the medial projecting portion 17 and the lower depending portion 18 of the siding starter clip 10 comprises an acute angle. The included angle 50 between the back surface 22 of the siding portion 20 and the back surface 22 of the bottom depending portion 23 of the siding starter panel 19 comprises a right angle, and the included angle 60 between the back surface 22 of the depending portion 23 and the back surface 22 of the rear upstanding portion 24 of the siding starter panel 19 comprises a right angle. A pair of gussets 70, 70' extend substantially the length of the siding starter clip 10.

In installing the siding starter clip 10, the installer strikes a line around the side walls of the structure at the height corresponding to the height of the top edge of the strip above ground level for the desired location of the strip and panel, then aligns the top edge 14 of the siding starter clip 10 with the struck line and drives nails through the apertures 25, 25', 25'' in the upper nailing leg portion 16 of the siding starter clip 10 for securing the siding starter clip 10 to the side of the structure. A series of such siding starter clips 10 are so installed at spaced-apart locations along the side of the structure as desired. The siding starter panel 19 is then positioned so as to enable the installer to interlock the bottom edge 15 of the lower depending leg portion 18 of each siding starter clip with the rear upstanding portion 24 of the siding starter panel 19 so as to lockingly engage the siding starter panel 19 on the side of the structure. The siding starter clips 10 are adjustable by pivoting or bending thereof, even after engagement with the panel, to compensate for variations in the side wall of the structure, in the clip, and in the panel, and are conveniently installable on site as set forth above so as to substantially reduce the difficulty of inerlocking the panel, and the time and cost thereof and enable installation of long siding panels on structures with long side walls; the gussets 70, 70' and the gauge of the clip provide strengthened support for the siding starter panel 10 interlocked with the siding starter clip 10.

While this invention has been particularly set forth in terms of specific embodiments thereof, it will be understood in view of the present disclosure that numerous variations upon the invention are now enabled to those skilled in the art, which variations nevertheless are within the scope of the present teaching. Accordingly the invention is to be broadly construed and limited only by the scope and spirit of the claims appended hereto

We claim:

1. A combined clip and siding panel for mounting on the side of the structure comprising:

(a) a clip including an elongated upper nailing leg portion provided with a plurality of apertures therein for securing the same to the structure side, (b) a medial projecting leg portion extending from and integral with the upper nailing leg portion at an obtuse angle thereto, (c) a lower depending leg portion terminating from and integral with the medial projecting leg portion at an acute angle thereto, (d) said lower depending leg portion terminating in a free edge for engagement of the siding panel therewith, (e) said upper extended nailing leg portion being of a length substantially greater than that of the lower depending leg portion, (f) gussets extending substantially the length of the clip, providing a reenforcing rib for increased strength of the clip, said gussets being so formed in spaced parallel relation along substantially the length in the clip, (g) said apertures in the upper nailing leg portion positioned therealong in spaced relation and being further so positioned therealong intermediate and parallel to said gussets, whereby fastening means may be passed through said apertures and into the structure side, to secure the clip and siding panel thereto, (h) said starter panel formed complementary to the clip for interengagement therewith and including an elongated front surface portion of greater length than the clip and having a depending portion extending rearwardly of the front surface portion of the starter panel, (i) a portion extending upwardly of the depending portion of the starter panel, (j) formed for interlocking with the free end of the lower depending leg portion of the clip and (k) terminating in an upwardly extending and outwardly directed free edge with which the lower depending leg portion of the starter clip engages for camming thereover and into said upstanding portion of the starter panel, to cam past said upwardly extending portion and interlock said medial projection leg portion of the clip, (l) said starter panel and clip being so proportioned as to so interlock in spaced relation to the wall of the structure and being readily bendable to compensate for variations in the wall of the structure, the clip and the panel so engagable therewith.

* * * * *